US007665732B2

(12) United States Patent
Stephens

(10) Patent No.: US 7,665,732 B2
(45) Date of Patent: Feb. 23, 2010

(54) LOTTERY GAME CARD WITH THERMAL INK TO HIGHLIGHT GAME INDICIA

(75) Inventor: Kenneth Stephens, Alpharetta, GA (US)

(73) Assignee: Scientific Games International, Inc., Newark, DE (US)

( * ) Notice: Subject to any disclaimer, the term of this patent is extended or adjusted under 35 U.S.C. 154(b) by 145 days.

(21) Appl. No.: 11/777,380

(22) Filed: Jul. 13, 2007

(65) Prior Publication Data

US 2008/0042345 A1 Feb. 21, 2008

Related U.S. Application Data

(60) Provisional application No. 60/839,085, filed on Aug. 21, 2006.

(51) Int. Cl.
*A63F 3/06* (2006.01)

(52) U.S. Cl. ..... 273/139; 273/269; 273/272

(58) Field of Classification Search ..... 273/139, 273/269, 272
See application file for complete search history.

(56) References Cited

U.S. PATENT DOCUMENTS

| | | | | |
|---|---|---|---|---|
| 5,560,608 | A | 10/1996 | Silverschotz | |
| 5,641,167 | A * | 6/1997 | Behm et al. | 273/269 |
| 2005/0258634 | A1 * | 11/2005 | Dronzek | 283/72 |

FOREIGN PATENT DOCUMENTS

| | | |
|---|---|---|
| EP | 0810013 | 12/1997 |
| EP | 1066978 | 1/2001 |
| GB | 2188283 | 9/1987 |
| WO | WO 03103983 | 12/2003 |

OTHER PUBLICATIONS

International Search Report Apr. 1, 2008.

* cited by examiner

*Primary Examiner*—Benjamin H Layno
(74) *Attorney, Agent, or Firm*—Dority & Manning, P.A.

(57) ABSTRACT

A scratch off lottery game card including a substrate on which a plurality of game indicia are printed on the substrate and a layer of translucent thermal ink coating is placed upon the lottery game card covering the game indicia. The translucent thermal ink coating changes its color when heat is applied, typically from the player scratching the game indicia.

13 Claims, 2 Drawing Sheets

LOTTERY GAME CARD WITH THERMAL INK TO HIGHLIGHT GAME INDICIA

PRIORITY CLAIM

The present application claims filing benefit of U.S. provisional patent application Ser. No. 60/839,085 filed on Aug. 21, 2006.

FIELD OF THE INVENTION

The invention relates to a lottery game and, more specifically, relates to a scratch-off lottery game card that shows a player's game indicia.

BACKGROUND OF THE INVENTION

A typical scratch-off game card for a bingo game has a game area with a plurality of pre-printed game letters and a player area with some pre-assigned letters. The game letters in the game area are usually visible to the player, while the pre-assigned letters in the player area are usually covered by an opaque removable layer. A player purchases a scratch-off bingo game card and removes the opaque removable layer to reveal the pre-assigned letters. When the player identifies a pre-assigned letter in the player area that matches a game letter from the game area, the player marks the game letter to identify it as a matched letter. The player can mark a game letter with a pen or pencil.

However, to make marking easier for the players, the game letters are usually covered by a layer of removable material and on the top of the layer the same set of game letters are printed. The player removes the layer of removable material, generally a scratch-off coating layer, by using his fingernail or a coin. The removal of the scratch-off coating layer on the top of a game letter provides an indication that the game letter has been "called." The player actually can feel the scratch-off coating layer when rubbing his fingernail over the lottery game card. When rubbed by a coin-or fingernail, a small amount of the scratch-off coating layer breaks into particles and collapses from the layer, thus revealing the pre-printed game letter below.

Therefore, it is desired to have a lottery game card with a protective layer that reveals game indicia without producing breakdown material and it is to such method the present application is primarily directed.

THE SUMMARY OF THE INVENTION

Objects and advantages of the invention will be set forth in part in the following description, or may be obvious from the description, or may be learned through practice of the invention.

In one exemplary embodiment of the present invention, there is provided a scratch off lottery game card on which a plurality of game indicia are printed on a substrate and a layer of a translucent coating of a thermally reactive ink is placed upon the lottery game card covering the game indicia. The translucent coating changes its color when a heat is applied, typically through the friction of a scratching action.

In another exemplary embodiment of the present invention, a game card is provided that includes a substrate, a player indicia area, and a game indicia area. A plurality of symbols are positioned in predetermined patterns in the game indicia area and in the player indicia area. A translucent layer is applied over one or more of the symbols in the game indicia area. The translucent layer comprises a coating (for example, a thermal ink) that changes in appearance upon the application of heat such as, for example, by being scratched or rubbed. The change in appearance can include a change in color. An opaque coating may be applied over one or more of the symbols in the player indicia area, wherein the opaque coating is removable by a player of the game card. The plurality of symbols may include alphanumeric characters or other types of indicia can also be used. The symbols in the game indicia area can be arranged into rows and columns.

In still another exemplary embodiment, a game card is provided having a substrate adapted to be printed upon. A player area is located upon the substrate that has player area indicia printed in the player area. A game area is also located upon the substrate and has game area indicia printed in the game area. A thermally sensitive coating is applied over the game area indicia and is configured such that the game area indicia are visible through the coating. The coating comprises a substance that changes appearance upon the application of heat so as to mark the game area indicia. Variations as previously summarized may also be applied.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION

Figure 1:
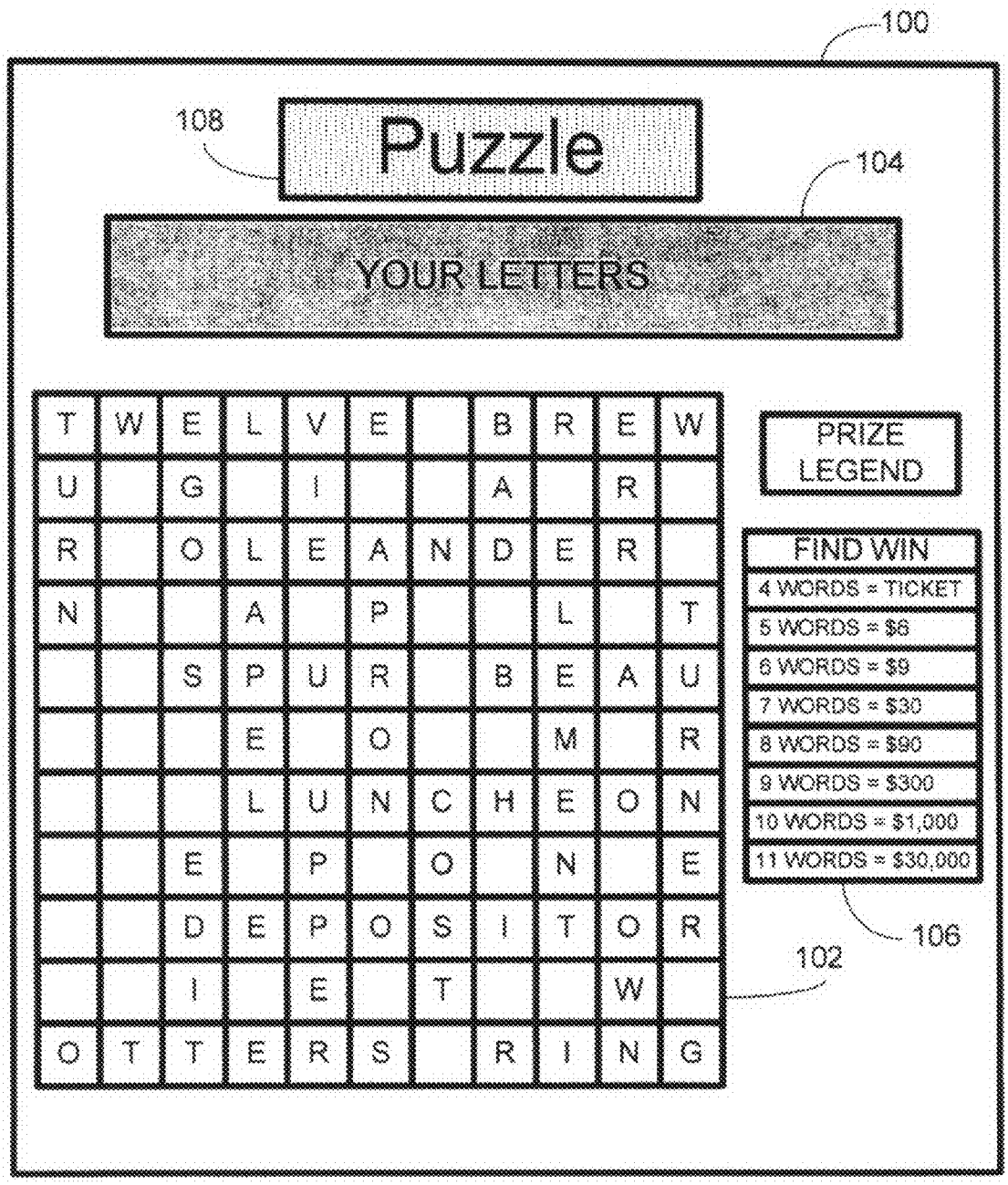
FIG. 1 illustrates a scratch-off card according to one embodiment of the invention.

Briefly described, in one embodiment the invention is a lottery game card in which a translucent layer of thermal ink coating is placed upon the game card covering the game indicia. When a player scratches the thermal ink coating covering the game indicia in a manner similar to scratching the scratch-off coating layer off a typical scratch-off coating coated scratch-off game ticket, the thermal ink coating covering the scratched area will change its color and enhance the game indicia underneath. FIG. 1 illustrates a lottery game card 100 for a word puzzle game according to one embodiment of the invention. The lottery game card 100 includes a game indicia area that includes a plurality of squares 102 arranged in a matrix format, and some of squares having a letter in it and forming some words or predefined patterns. The lottery game card 100 also includes a player indicia area 104 labeled as "YOUR LETTERS" in which certain letters are printed and covered by an opaque material, such as a scratch-off coating layer that breaks into particles or collapses from the layer when scratched so that a portion of the layer can be removed leaving the letter underneath intact. The lottery game card 100 further includes a prize area 106, wherein a list of prizes is listed.

A player can purchase a lottery game card 100 at any lottery game retailer. After purchasing the lottery game card 100, the player scratches off the player indicia area 104 labeled as "YOUR LETTERS" to reveal the letters. After revealing the letters, the player can then match each letters listed in the player indicia area 104 with letters in the squares 102. To track and easily identify the letters in the game indicia area 102 that match the letters in the player indicia area 104, the player scratches the square having a letter that matches a letter in the player indicia area 104. The thermal ink in the scratched area changes its color to a color, for example red, that is easily observable by the human eyes. If the player matches a number of words that is listed in the prize area 106, then the player wins the prize that matches the number of words.

The game card 100 comprises a simple flat substrate of a suitable card material on which printing can be received, generally of paper. Onto the substrate is printed a first area having a plurality of squares in the game indicia area 102, a second area 108 with the game title, a player indicia area 104 with a pre-assigned letters, and a fourth area 106 listing prizes. After the first area is printed with plurality of digits in the squares, a layer of translucent coating is placed on the top of the first area. The translucent coating is made from a thermally reactive ink, which, when heated, changes its color. The heating can be provided by scratching the area covered by the thermal ink. Once the translucent coating changes its color, the color will not disappear when the heat is dissipated.

Figure 2:
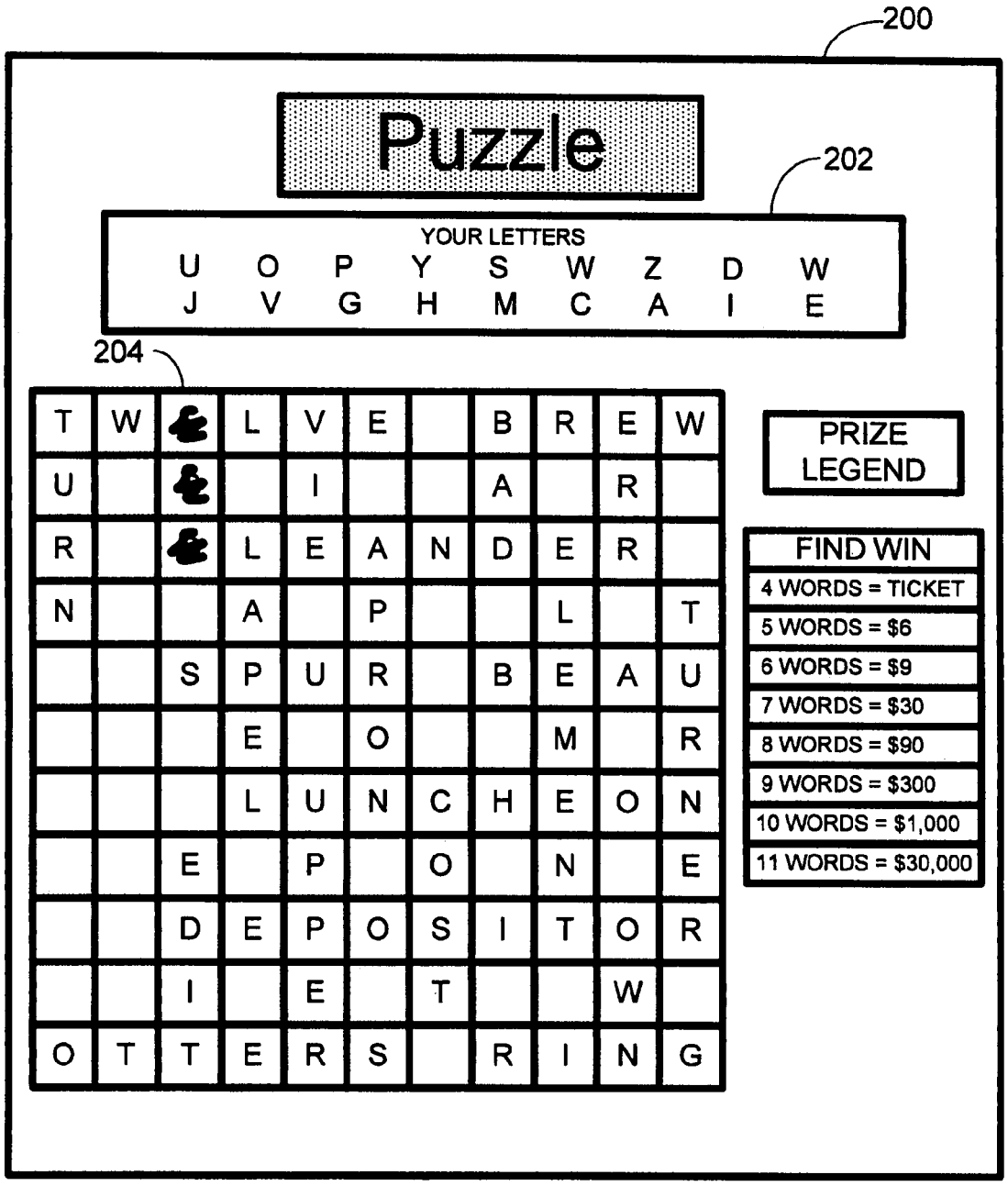
FIG. 2 illustrates the scratch-off game card with a few spots having game indicia scratched.

FIG. 2 illustrates a lottery game card 200 that illustrates a game card with the pre-assigned letters 202 revealed and few squares 204 scratched off. Because the area that has been scratched changes its color, the player can now easily identify the words he has formed so far.

The lottery game card includes a substrate, a game indicia area, and a player indicia area. The game indicia area includes a plurality of letters forming a plurality of predefined patterns. A layer of translucent thermal ink coating is placed upon at least the plurality of letters and the layer of translucent coating changes its color when heat is applied.

Although preferred embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. Moreover, although specific terms are employed herein, they are used in a generic and descriptive sense only, and not for the purposes of limiting the described invention.

What is claimed is:

1. A game card comprising:

a substrate;

a player indicia area;

a game indicia area;

a plurality of symbols positioned in predetermined patterns in said game indicia area and in said player indicia area;

a translucent layer applied over one or more of said symbols in said game indicia area, said translucent layer comprising a thermal ink coating that changes in appearance upon the application of heat.

2. The game card of claim 1, wherein said translucent layer comprises a coating that changes in appearance upon being scratched or rubbed.

3. The game card of claim 2, further comprising an opaque coating applied over one or more of said symbols in said player indicia area, wherein said opaque coating is removable by a player of the game card.

4. The game card of claim 1, wherein said plurality of symbols comprise alphanumeric characters.

5. The game card of claim 1, wherein said translucent layer changes color upon the application of heat.

6. The game card of claim 1, wherein said plurality of symbols in said game indicia area are arranged into rows and columns.

7. A game card comprising a substrate adapted to be printed upon;

a player area located upon said substrate and having player area indicia printed in said player area;

a game area located upon said substrate and having game area indicia printed in said game area; and a thermally sensitive coating applied over said game area indicia and configured such that said game area indicia are visible through said coating, wherein said coating comprises a substance that changes appearance upon the application of heat so as to mark said game area indicia.

8. The game card of claim 7, wherein said game area indicia comprise alphanumeric characters.

9. The game card of claim 7, further comprising an opaque layer positioned over said player area indicia, said opaque layer being removable by scratching or rubbing.

10. The game card of claim 7, wherein said game area indicia are arranged in predetermined patterns within a grid.

11. The game card of claim 7, wherein said player area indicia and said game area indicia each comprise alphanumeric characters, and wherein at least one of said player area indicia matches one or more of said game area indicia.

12. The game card of claim 7, wherein said coating changes color upon being rubbed or scratched by a player.

13. The game card of claim 7, wherein said coating comprises a thermally-sensitive ink.

* * * * *